US011499797B2

(12) United States Patent
Mantas

(10) Patent No.: US 11,499,797 B2
(45) Date of Patent: Nov. 15, 2022

(54) INTELLIGENT MULTIPURPOSE FLEXIBLE RIFLE GRIP

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 109 days.

(21) Appl. No.: 17/062,892

(22) Filed: Oct. 5, 2020

(65) Prior Publication Data

US 2021/0278168 A1 Sep. 9, 2021

Related U.S. Application Data

(63) Continuation-in-part of application No. 16/808,082, filed on Mar. 3, 2020, now Pat. No. 11,112,208.

(51) Int. Cl.
*F41C 23/16* (2006.01)
*F41A 23/06* (2006.01)

(52) U.S. Cl.
CPC ..... *F41C 23/16* (2013.01); *F41A 23/06* (2013.01)

(58) Field of Classification Search
CPC ..... F41C 23/16; F41A 23/06
See application file for complete search history.

(56) References Cited

U.S. PATENT DOCUMENTS 3,164,920 A * 1/1965 Haas, Jr. ..... F41C 23/16 42/71.01
4,393,614 A * 7/1983 Pickett ..... F41A 23/06 42/94
5,074,188 A * 12/1991 Harris ..... F41A 23/08 89/37.04
5,194,678 A * 3/1993 Kramer ..... F16M 11/242 89/37.04
5,274,940 A * 1/1994 Guzy ..... F16M 11/08 89/37.04
6,007,259 A * 12/1999 Mori ..... F16M 11/10 396/428
6,305,116 B1 * 10/2001 Parker ..... F41A 23/04 89/37.04
7,322,142 B1 1/2008 Leung
7,571,563 B2 * 8/2009 Peterson ..... F41A 23/08 248/165
7,584,568 B1 * 9/2009 Brownlee ..... F41C 23/16 89/37.01
7,614,174 B1 * 11/2009 Beltz ..... F41A 23/10 42/72
7,654,498 B1 * 2/2010 Beltz ..... F41A 23/06 248/351
8,904,693 B1 * 12/2014 Beltz ..... F41A 23/10 42/72
9,573,268 B2 * 2/2017 Azhocar ..... B25G 1/06
9,593,901 B1 * 3/2017 Reed ..... F41C 33/002
9,709,356 B1 * 7/2017 Anstett ..... F41C 23/16
10,082,363 B2 9/2018 Burgess
10,527,387 B1 * 1/2020 Oliva Chavez ..... F41C 23/16
10,866,061 B2 * 12/2020 Anstett ..... F41C 23/16
11,150,046 B2 * 10/2021 Keller ..... F41A 23/10
(Continued)

*Primary Examiner* — Michelle Clement
(74) *Attorney, Agent, or Firm* — Notaro, Michalos & Zaccaria P.C.

(57) ABSTRACT

A handguard grip assembly has a connector to be fixed to a barrel of a rifle, the barrel having a barrel axis, a grip having a grip axis and adapted to be held by a user of the rifle and a flexible joint connected between the connector and the grip for allowing the grip and grip axis to pivot to any angle with respect to the barrel axis.

6 Claims, 17 Drawing Sheets

(56) References Cited

U.S. PATENT DOCUMENTS

2003/0140543 A1* 7/2003 Yeargin ..... F41A 23/10 42/94
2003/0192223 A1* 10/2003 Sharp ..... F41A 23/10 42/94
2005/0207749 A1* 9/2005 Barker ..... F16M 11/28 396/428
2005/0241206 A1* 11/2005 Teetzel ..... F41A 23/08 42/72
2007/0079541 A1* 4/2007 Peterson ..... F41A 23/08 42/94
2009/0193702 A1* 8/2009 Lin ..... F41C 23/16 42/72
2009/0313873 A1* 12/2009 Roth ..... F41C 23/16 42/72
2011/0047850 A1* 3/2011 Rievley ..... F41C 23/22 42/114
2011/0047851 A1* 3/2011 Mock ..... F41C 23/16 42/72
2011/0173867 A1* 7/2011 Young ..... F41A 23/10 42/94
2011/0179688 A1* 7/2011 Ash, Jr. ..... F41C 23/14 42/72
2013/0174463 A1* 7/2013 Hinds ..... F41C 27/22 42/94
2013/0333263 A1 12/2013 Hovey
2014/0182182 A1 7/2014 Adcock, Jr.
2014/0196342 A1 7/2014 Syrengelas et al.
2016/0238336 A1* 8/2016 Bartak ..... F41A 23/10
2016/0332290 A1* 11/2016 Azhocar ..... F16M 11/14
2016/0332291 A1* 11/2016 Azhocar ..... F16M 11/14
2017/0089659 A1* 3/2017 Almond ..... F41C 23/16
2018/0180375 A1* 6/2018 Macken ..... F16M 11/26
2019/0390935 A1* 12/2019 Purkiss ..... F41C 23/16
2020/0103196 A1* 4/2020 Keller ..... F16M 11/041
2020/0292270 A1* 9/2020 Ingram ..... F16M 11/26
2021/0102783 A1* 4/2021 Ma ..... F41A 3/66
2021/0293504 A1* 9/2021 Wynalda, Jr. ..... F41A 23/06
2022/0034339 A1* 2/2022 Keller ..... F41A 23/08

* cited by examiner

INTELLIGENT MULTIPURPOSE FLEXIBLE RIFLE GRIP

CROSS-REFERENCE TO RELATED APPLICATION

This is a continuation-in-part of U.S. patent application Ser. No. 16/808,082 filed Mar. 3, 2020 which is incorporated herein by reference.

FIELD AND BACKGROUND OF THE INVENTION

The present invention relates generally to the field of firearms and in particular to new and useful multipurpose, flexible grip for connecting to the forestock, forend, forearm or handguard of a rifle, that enhances the use and versatility of the rifle in an intelligent manner.

Rifles or long guns with a barrel that extends forwardly of the weapon receiver, often include a handguard of plastic or wood, over the barrel to protect the users "weak" hand that normally grips the weapon somewhere along the barrel. In the case of military and law enforcement rifles, commonly called assault rifles, that may operate in semiautomatic and automatic modes, the handguard, that is here interchangeably called the forestock, forend or forearm of the rifle, may include one or more elongated mounting rails for mounting various accessories. Such accessories may include a flashlight, an aiming laser, a mono-pod or bi-pod and/or a handguard grip.

In the case of a handguard grip, these are useful to support and control pointing and aiming of the weapon, especially, but not excessively during automatic fire.

Handguard grips are often but not always connected to the rifle by a connector that attaches to the handguard rail and are always fixed in position. This position is most often perpendicular to the barrel axis but some such grips can be at a rearward angle to the axis or may be moved into different angular, but fixed positions to accommodate the users preference. The handguard grip is grasped by the weak hand, and helps the user achieve a more favorable and comfortable support and control of the weapon. The term weak hand is meant to contrast the users "strong" or dominant hand that holds the trigger grip in normal use, but in military and law enforcement situations, all shooters must be trained and be able to switch hands for tactical reasons. For example, when approaching a doorway in a combat situation, the soldier may not have the luxury of approaching from the left for maximum cover, in the case of a right-handed person. The soldier must be able to become left-handed at this time and approach from the right side of the doorway.

Thus, while ambidextrous usage of the rifle is required, in the case there is it desired to have the handgrip extend to one side of the barrel or the other, current grips cannot active this. Even if a grip can be repositions, e.g. by attaching it to a side rail of a rifle equipped with a quad-rail system, this takes time and would not be appropriate in a combat situation.

While generally favorable for use of a military and law enforcement rifle, a handguard grip may also have disadvantages. Being fixed in place, it may catch on clothing, other equipment and surroundings. When entering and leaving a vehicle, the handguard grip may strike the users thigh causing pain and momentary diversion of focus that is not good in any potentially dangerous situation. When an occasion arises requiring the rifle to be aimed out through a vehicle or building window, the fixed grip may hinder deploying or retracting the rifle as the grip may get caught on the window or window sill. Many other and varied scenarios exist that illustrate the potential disadvantage of a fixed handguard grip.

U.S. Pat. No. 9,573,268 to Azhocar discloses a swivel handle assembly with a ball attachment including an elongated grip handle that must be twisted in one direction to loosen the engagement with a ball of the ball attachment, to allow the handle to be tilted, within limits, to any angle with respect to the barrel axis. The grip handle is then twisted in the opposite direction to tighten the engagement with the ball to fix the grip handle position. By requiring untwisting and then re-twisting of the grip handle before a new position can be secured, time and dexterity as well and the precision of aiming are lost. This can have fatal consequences during a combat situation. In addition, the locked grip poses a possible safety hazard as mentioned above.

SUMMARY OF THE INVENTION

It is an object of the present invention to provide an improvement in handguard grips that both obviates the problems caused by a fixed handguard grip and at the same time offer many new and useful capacities that are not possible using currently known handguard grip design.

Accordingly, a further object of the invention is to provide a handguard grip assembly that has a connector to be fixed to a barrel of a rifle, the barrel having a barrel axis, a grip having a grip axis and adapted to be held by a user of the rifle, and a flexible joint connected between the connector and the grip for allowing the grip and grip axis to pivot to any angle with respect to the barrel axis.

The grip may contain nothing, or a spring-loaded mono-pod module, or a flashlight module.

The flashlight module is battery operated with a visible or invisible (e.g. IR) LED and conical shroud around the LED so the LED is recessed inside the grip end. This has advantages in that the light cast by the LED is not visible, or detectable in the case of IR light, from the side, and only points down or at any angular position that is controlled by the user. IR or inferred light can be used with night vision goggles or low power (effective only 2 to 3 meters way) visible light is used if no night vision is available to avoid detection of the user by the enemy. The battery powered module can be replaced by the mono-pod module by opening two clam shell sides of the handle forming the grip.

In another embodiment of the invention, threaded attachments at the bottom of the grip can be used to exchange modules on the fly. In this way the user, i.e. a soldier in the field, can switch from flashlight to mono-pod, easily and quickly.

The flashlight, being at the end of the flexibly mounted grip, allows the user to aim and scan an area without having to aim the weapon in the same direction, thus providing no advantage to the enemy in cases where the flashlight would have been attached to the barrel and must always have point along the barrel axis. This allows the user to point the flashlight in any direction because of the flexible mount. Being able to point and scan the flashlight in any direction by virtue of the flexible joint between the grip and the rifle confuses the enemy into thinking that the user is behind the light (since they assuming the light is attached to the barrel), but in fact can be perpendicular to the barrel thus providing more safety to the soldier. As mentioned, the light source is recessed from the rim of the grip in its housing so that it is not visible from the side.

Another object of the invention is to provide a handguard grip assembly for a rifle having a barrel with a barrel axis and a handguard extending at least partly around the barrel, the assembly comprising a connector adapted to be fixed to the rifle handguard, a grip having a grip axis and being adapted to be held by a user of the rifle, and a flexible joint connected between the connector and the grip for allowing the grip to pivot as long as the grip is being held, so that the grip axis is at any selected angle to the barrel axis. The handguard includes a mounting rail in a preferred embodiment, and the connector has a channel for engaging the rail.

The connector between the rail and the top of the grip is fixed and has a recess or shaped area near the rail so that one can engaged this recess or area with an index finger of the weak hand, so that one has a more conventional fixed connection between their hand and the barrel. This avoids the possible inaccuracy of a flexible holding position. The invention allows the weak hand to have an important and critical role in that it now can flex the barrel grip into any position. Also, when used with the flashlight module, it can cast light in any direction with the advantages mentioned above.

Providing a grip alone or grip with mono-pod which can be angled in any position and also which is flexibility mounted, prevents the handguard grip from catching on anything that would be the case for a rigidly mounter grip. This also allows the user's weak hand to have flexibility in how the grip is held and angled, allowing the user's strong hand that hold the trigger grip less tightly since it need no longer accommodate the weak hand since the weak hand can take any comfortable position that is economically proper for the shooting position.

By allowing the handguard grip to be moved as far as 90 degrees back and 45 degrees or more rearwardly and in any direction, the shooter can actually brace his/her elbow against their body and provide a more secure, shooting-match-like shooting position. In this way, by bracing your elbow against the body while still holding the handguard grip, the strong hand is given the freedom to more loosely hold the trigger grip and squeeze off a more accurate shot.

The flexibility also prevents the handguard grip from acting like a hook and hooking onto different obstacles inadvertently. Also, when one gets into or out of a sitting position, for example, into a vehicle, often a rigid handguard grip will hit against the thigh causing pain. In this case the flexible grip of the invention moves out of the way, avoiding this possible cause of injury or at least unwanted distraction.

The bottom cap of the empty grip or flashlight or the cap of the mono-pod have flat side areas so they do not rotate in the halves of the handle forming the grip. High friction rubber or other appropriate elastomer piece making up the flexible joint also has flat areas at the top and bottom to resist rotation. The rubber piece also was a durable fabric covering, such as nylon, to prevent nicking or other damage to the surface of the rubber. Also, the outer shape of the grip can be as desired with finger recesses or smooth or textured or as preferred by the user.

The bottom of the mono-pod is also high friction rubber to avoid slippage and also to provide flexibility and some resiliency against a fixed support.

Another advantage of the flexibly mounted handguard or barrel grip is that it accommodates the many different and sometimes awkward positions that are required during training of any active unit to be able to shoot from awkward positions such as kneeling, lying down, hiding behind different obstacles, and the like.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
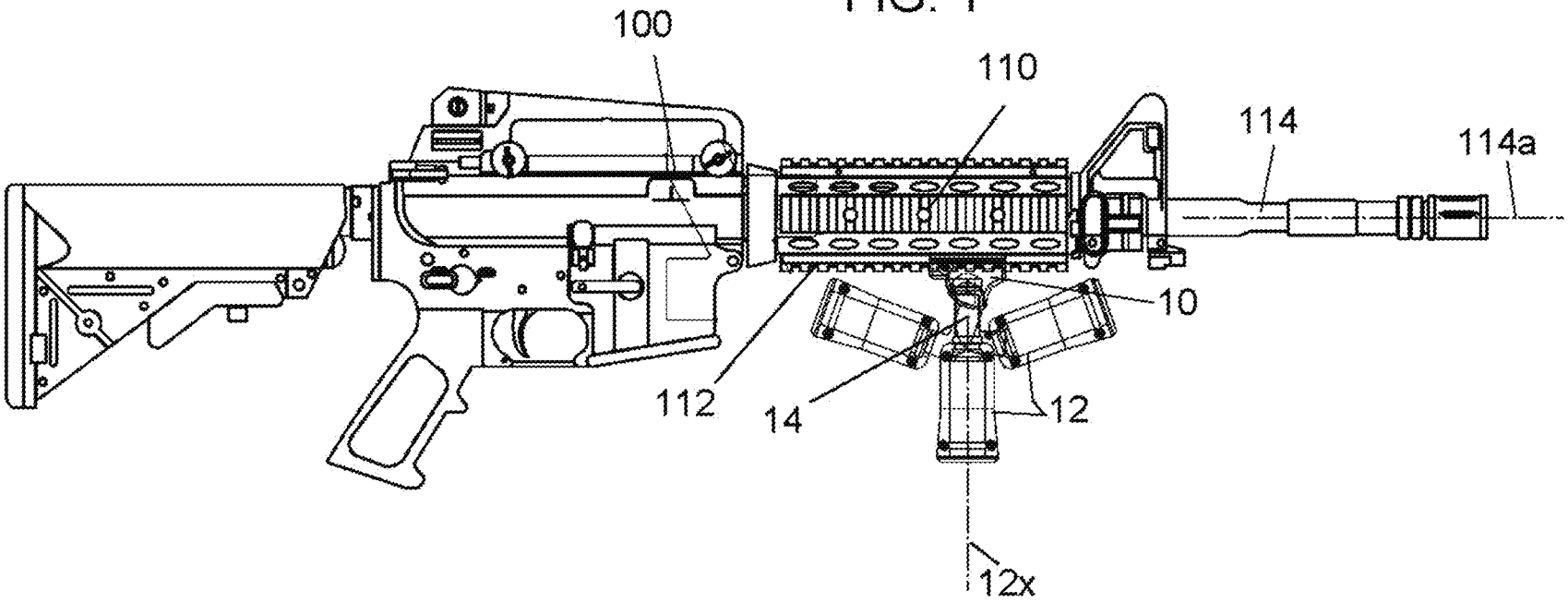
FIG. 1 is a side view of a rifle with the barrel or handguard grip assembly of the invention installed.

Referring now to the drawings, in which like reference numerals are used to refer to the same or similar elements, FIG. 1 illustrates a handguard grip assembly for a rifle 100 having a barrel 114 with a barrel axis 114*a* and a handguard 110 extending at least partly around the barrel, which assembly comprises a connector 10 adapted to be fixed to the rifle handguard 110, in particular, to the mounting rail 112 along the bottom of many modern military and law enforcement rifles.

The assembly includes a grip 12 having a grip axis 12*x* and being adapted to be held by a user of the rifle, normally by the weak hand of the user during normal carry and use. A flexible joint 14 is connected between the connector 10 and the grip 12, for allowing the grip to be manually pivoted into any angular position as long as the grip is being held, so that the grip axis is at any selected angle to the barrel axis. This capacity gives the user new and advantageous abilities that are not available with fixed handguard grips.

Figure 3:
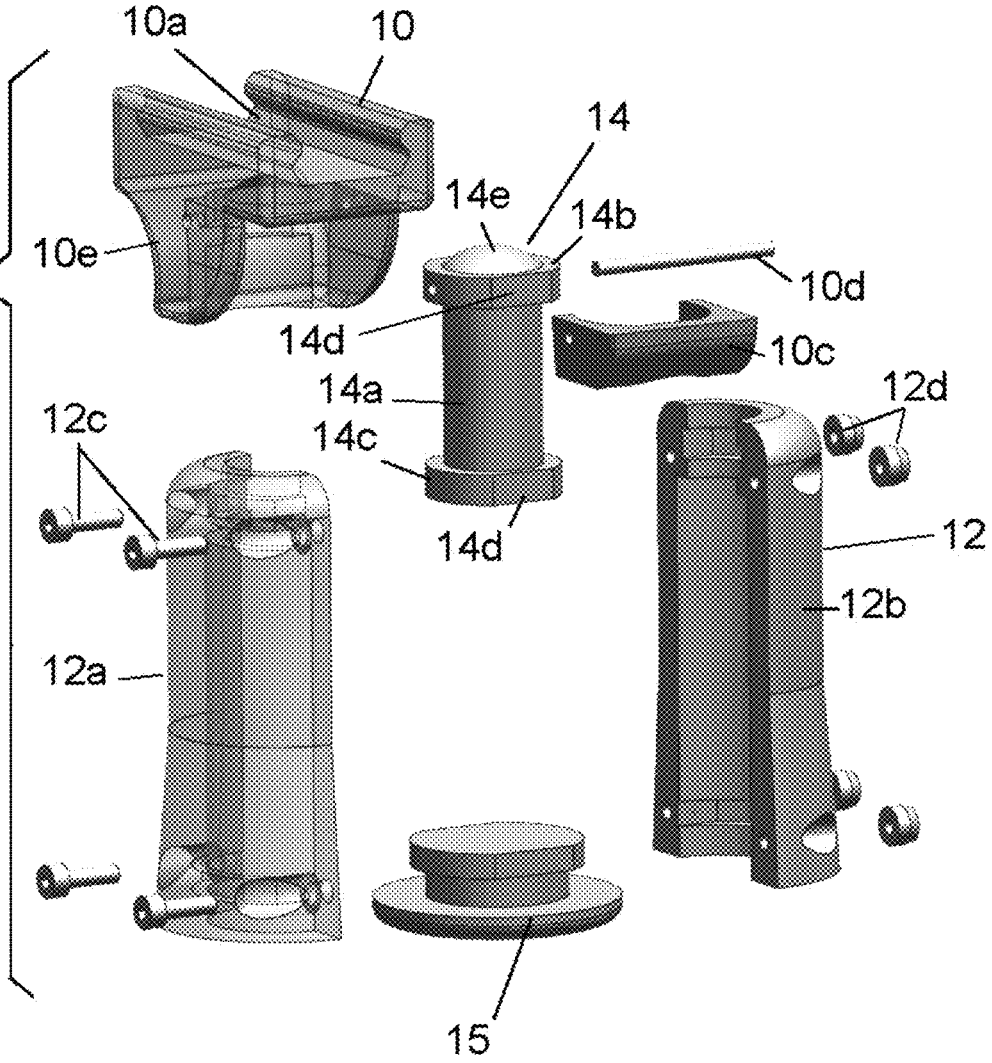
FIG. 3 is an exploded view of the grip assembly of the invention with no module included but rather with an empty handle housing.

The flexible joint 14 of the grip assembly is preferably a one-piece elongated elastomer member best shown in FIG. 3, with shore hardness between about 65 and 80 or more preferably about 75 to 80. The inventor, an experienced user of military and law enforcement weapons, has found that this level of elastic bendability gives the user the best balance of resistance to bending and return to initial position for the movement of the grip 12 in a wide variety of holds for support, for aiming and for shooting.

Figure 4A:
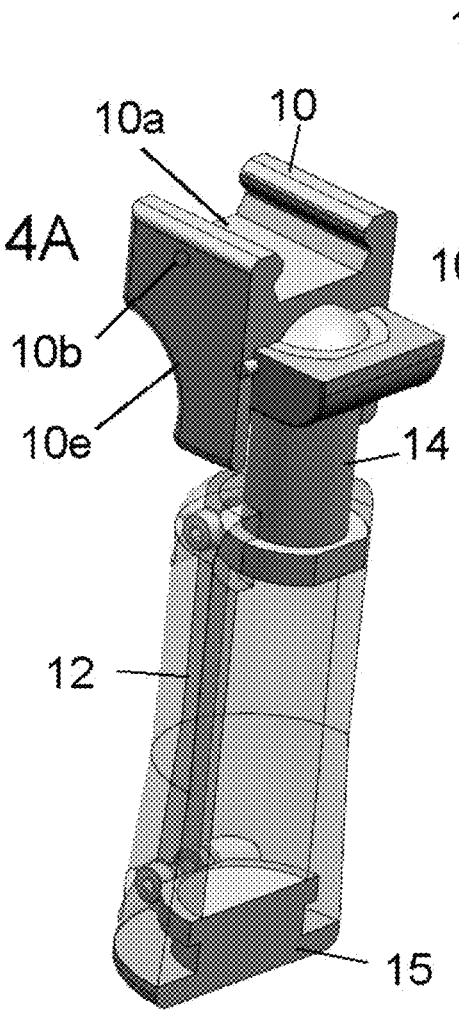
FIG. 4A is a view, partly in section of the grip assembly of FIG. 3.
Figure 4B:
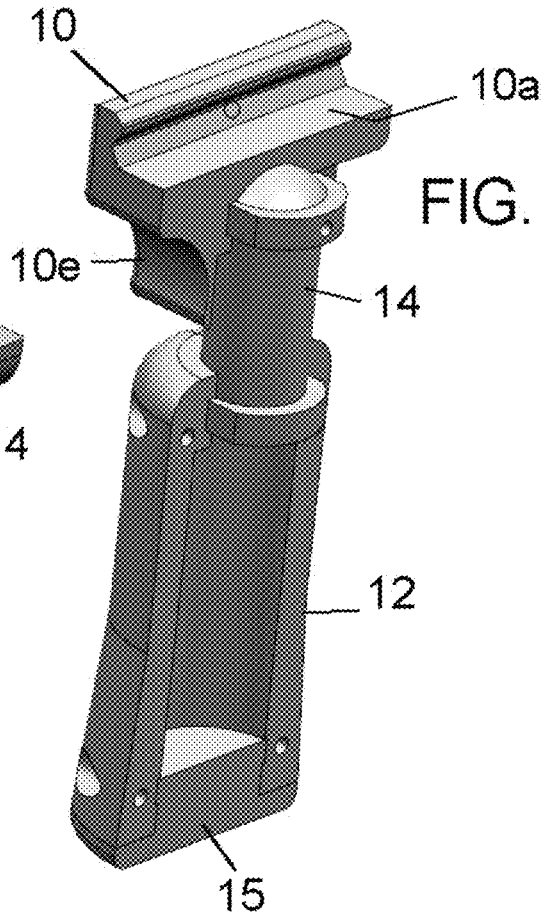
FIG. 4B is a view like FIG. 4A but with the assembly rotated 90 degrees.

The flexible joint 14 is an elongated elastomer member having a central cylindrical portion 14*a*, an upper larger diameter portion 14*b* with at least one non-round area, e.g. opposite flat areas 14*d*, so as to be non-rotatable fixed to the connector 10, and a lower large diameter portion 14*c* with at least one non-round area, e.g. flats 14*d*, so as to be non-rotatably fixed to the grip 12. To this end the connector 10 has a shaped recess for containing the upper portion 14*c*, that matches the size and shape of the upper portion, and the upper clam-shell halves 12*a* and 12*b* of the grip 12, have likewise shaped recess halves for together containing the upper portion 14*c*, that match the size and shape of the upper portion 14*c*. When closed together and fastened by screw and nut combinations 12*c* and 12*d*, the halves 12*a* and 12*b* form the grip 12 as shown in FIGS. 4A and 4B. The hollow grip 12 with no module inside is completed by an end cap 15 made of the same or different elastomer as flexible joint 14, and likewise includes a cylindrical portion with flat areas that nest in a like-shaped recesses formed in the bottoms of the grip halves 12*a* and 12*b*, so as to resist rotation of the end cap 15.

Grip halves 12*a* and 12*b* are made of hard durable material like suitable synthetic polymer or metal.

The connecter 10 is preferably made of hard durable material like suitable metal or synthetic polymer and has an internal dome hollow that receives an upper dome 14*e* of flexible joint 14. Connector 10 also has a channel 10*a* for engaging the handguard rail and a set screw 10*b* for fixing the connecter to the handguard. A filler piece 10*c* of metal or plastic is connected to the remainder of the connector by a pin 10*d* and forms the back part of the anti-rotation recess for the upper portion 14*b* of the joint 14. The front lower part of connected 10 is also shaped with a curved finger recess 10*e* for the user's index finger if the user wishes to increase the security of his/her hold on the grip-plus-connector combination.

In another embodiment, the flexible joint 14 can be made of a strong coil spring with touching coils in an un-bend condition and a durable fabric cover sheath or nylon or other durable material.

Figure 9A:
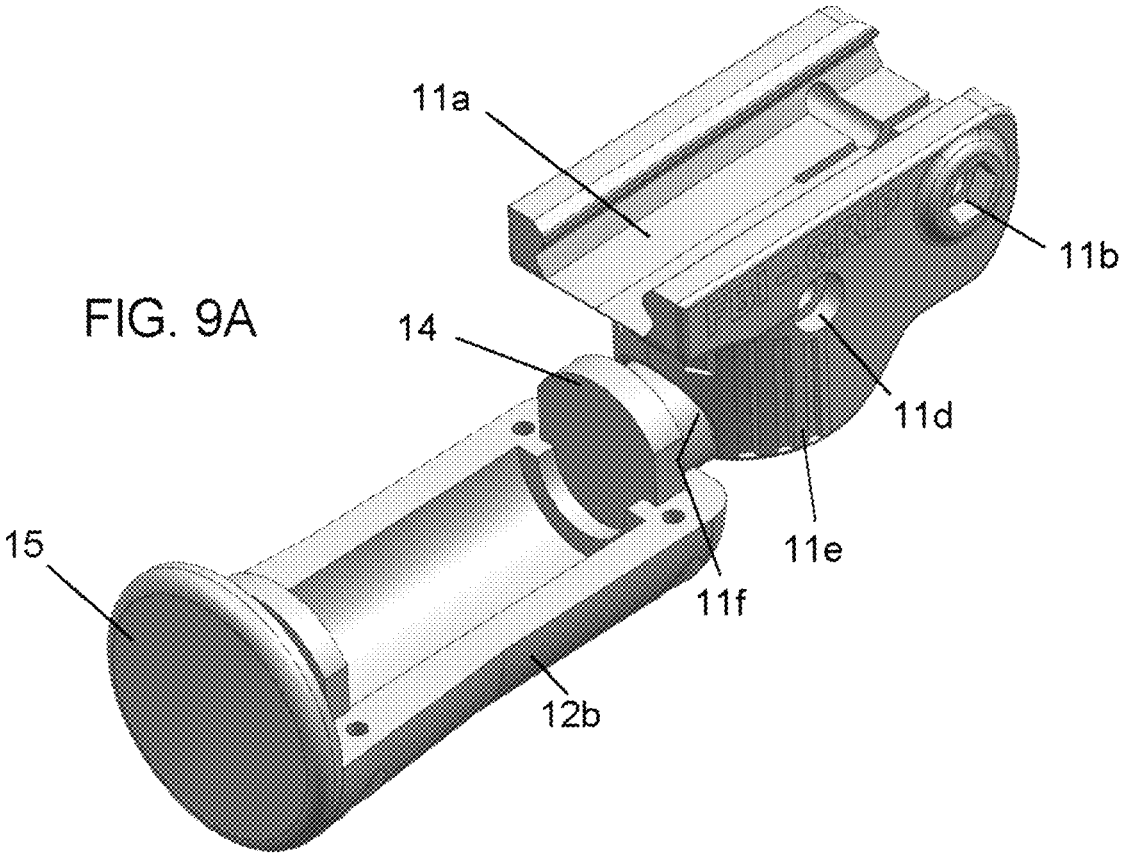
FIG. 9A is a view, partly in section of another embodiment of the grip assembly showing details of the connector.
Figure 9B:
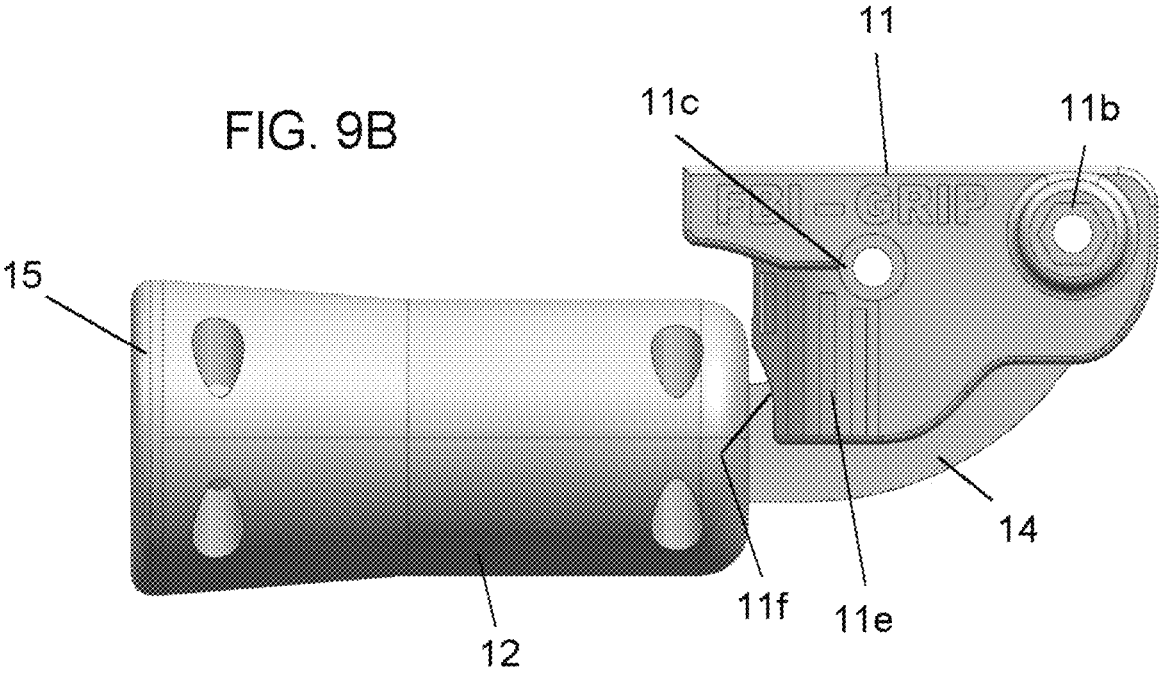
FIG. 9B is a side elevation of the embodiment of FIG. 9A, showing how the flexible joint can fully nest in a provide recess in the connector.

FIGS. 9A and 9B illustrate a second embodiment of the connecter 11, which includes a rail channel 11*a*, a set screw 11*b* for fixing it to the handguard rail, a pin 11*d* for fixing the upper end of the flexible joint 14 to the connector 11, a curved and textured index-finger engaging surface 11*e* for the user to hook with his/her index finger and a curved recess 11*f* for receiving the joint 14 when its elongated central cylinder in bend by 90 degrees forwardly so that it may be made to lay flat up against the bottom of the handguard rail for storage of the weapon or in some cases during use when the shooter wished to manually press the grip up against the rail.

FIG. 1 shows the extreme forward and rearward positions into which the grip can be bent. In likewise fashion, the grip can be bent to either side for any ambidextrous and ergonomic hold of the forward part of the weapon.

Figure 2:
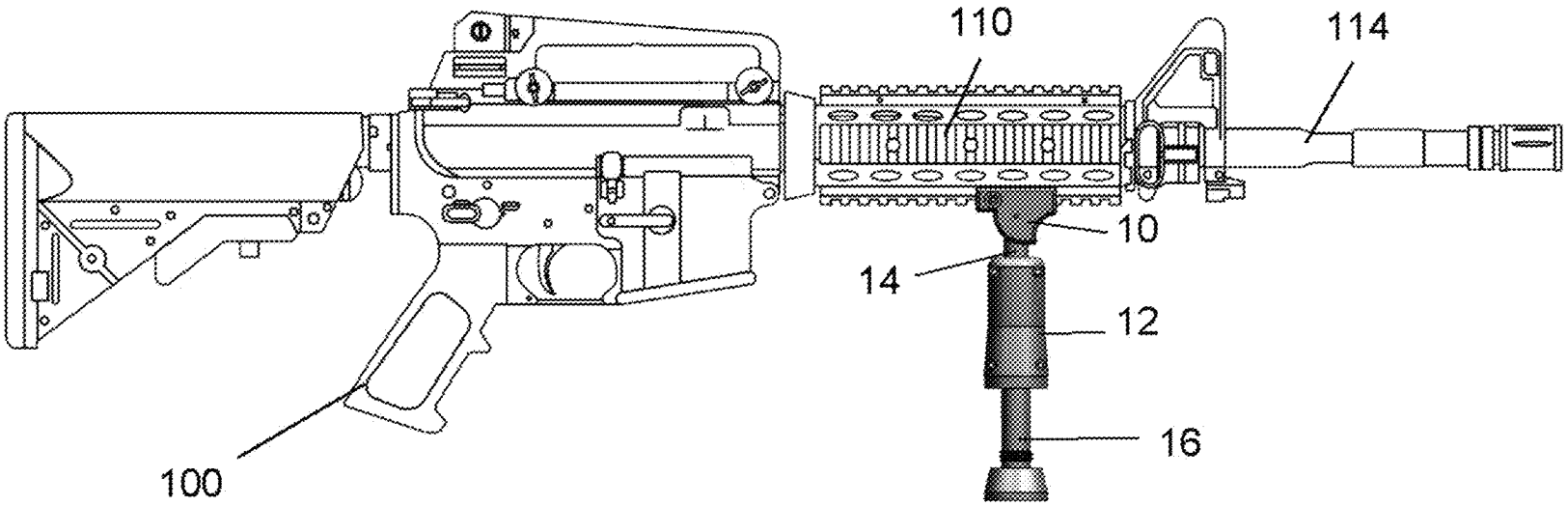
FIG. 2 is a view similarly to FIG. 1, with a mono-pod module in the grip assembly.
Figure 8:
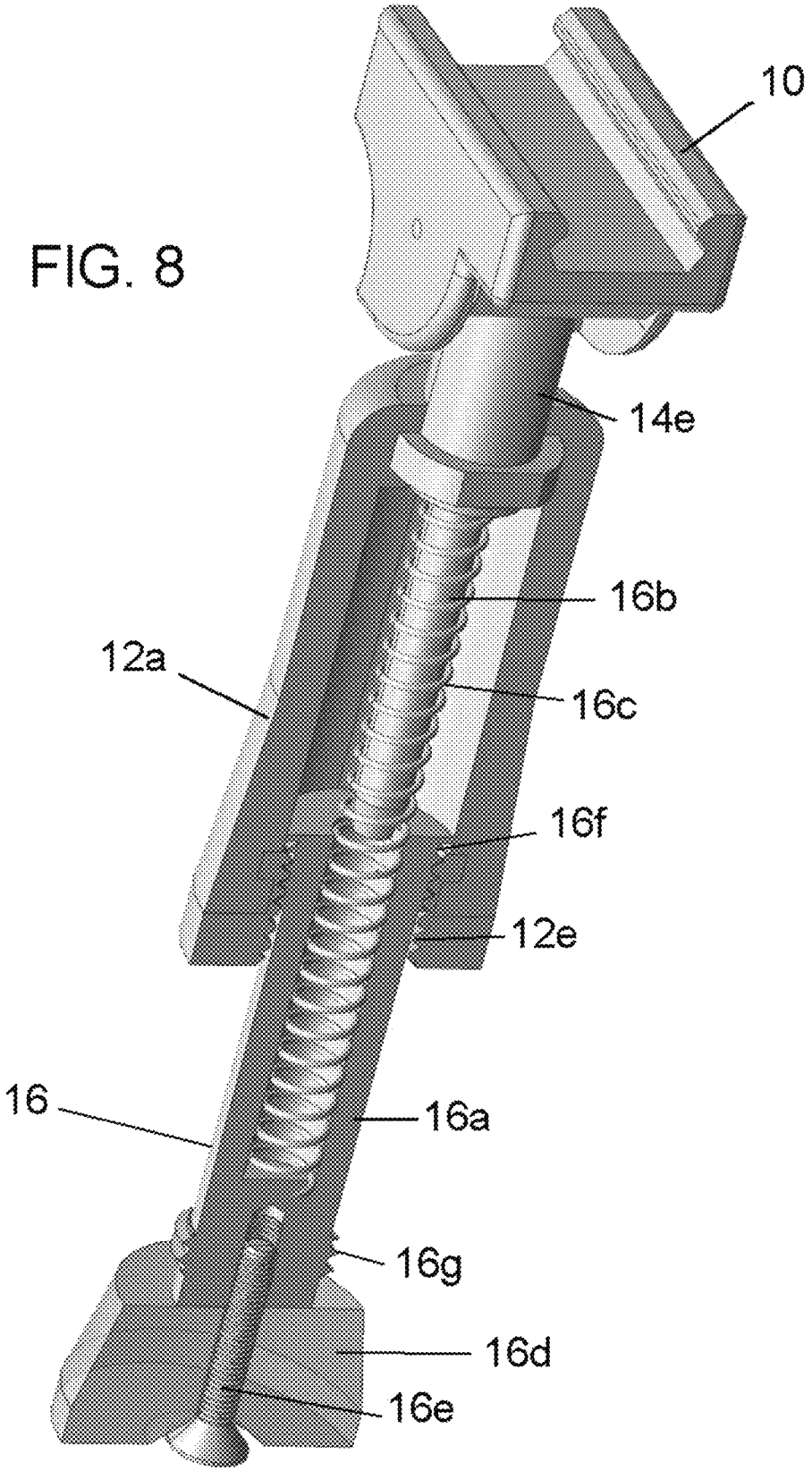
FIG. 8 is a view, partly in section of the grip of the invention with a mono-pod module installed.

With reference to FIGS. 2 and 8, a mono-pod module 16 can be connect into the grip of the invention. The mono-pod comprises one or more parts that are telescopically connected to the grip for linearly expanding the effective length of the grip and allowing the forward part of the rifle to rest on a support surface to improve aiming.

The mono-pod 16 has an outer cylinder 16*a* telescopically slidable in the grip 12, an inner cylinder 16*b* engaged with the bottom of the flexible joint 14, a spring 16*c* between the inner and outer cylinders for biasing the outer cylinder outwardly of the grip, and an elastomer foot 16*d* connected to a lower end of the outer cylinder by a screw 16*e*.

To securely position the mono-pod either extended from or retracted in grip 12, the outer cylinder 16*a* has upper and lower threads 16*f* and 16*g* for threading to internal grip threads 12*e* in the grip in respective outer and inner positions of the mono-pod in the grip. The extending position in FIG. 8, for example, can be changed to the retracted position with outer cylinder 16*a* fully inside the grip 12, by holding and rotating the elastomer foot 16*d* to unthread the upper mono-pod threads 16*f* from the internal grip threads 12*e*. Once unthreaded, the user pushes the foot 16*d* up against the bias of spring 16*c* into the grip housing and then rotates the foot in an opposite direction to now thread the lower threads 16*g* onto the grip thread 12*e* to fix the mono-pod in its retraced position.

In FIG. 8, the cylindrical portion of the elastomer member forming the flexible joint 14, is covered by a durable fabric cover layer 14*e*, of nylon or other durable and flexible material to protect this bendable part of the joint from damage.

Figure 5:
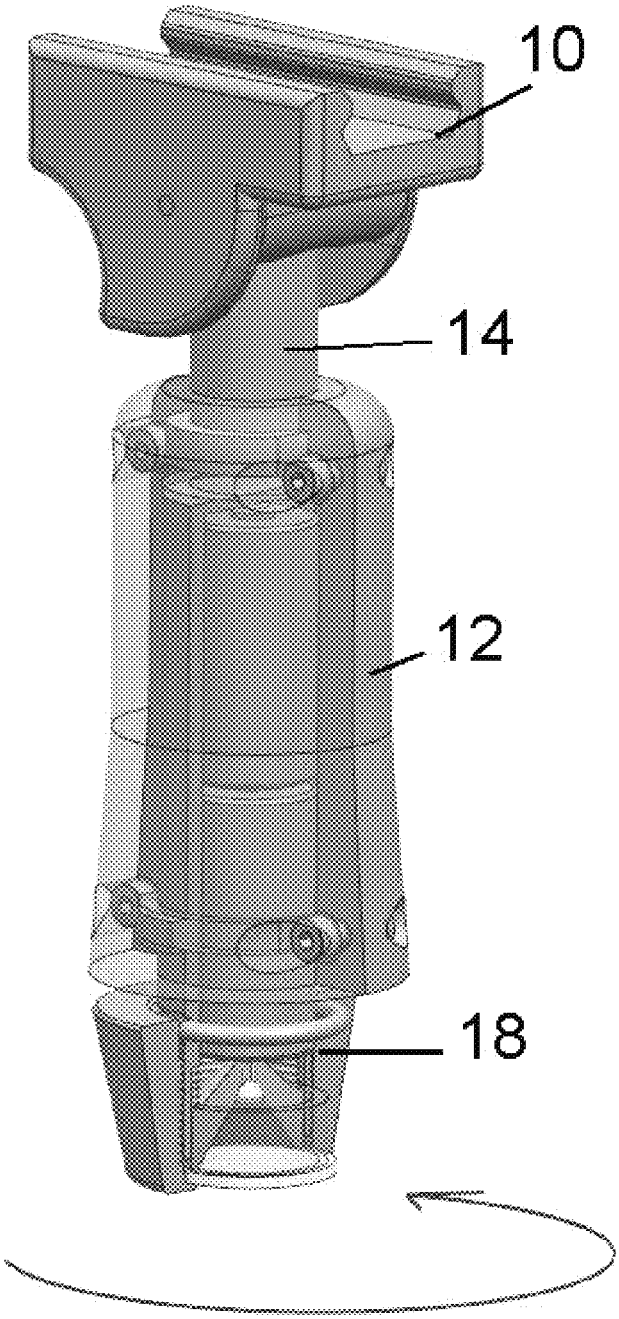
FIG. 5 is a view, partly in section of the grip assembly with a flashlight module installed.
Figure 6:
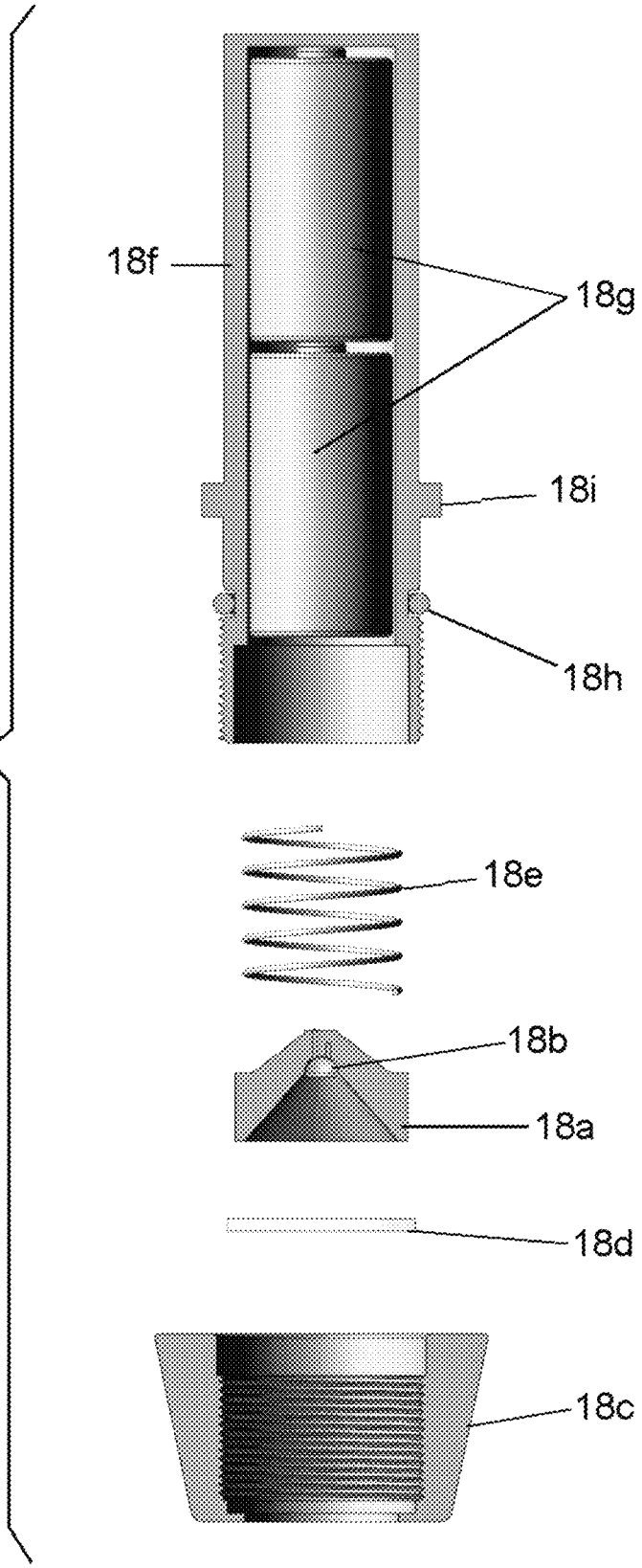
FIG. 6 is an exploded view of the flashlight module.
Figure 7:
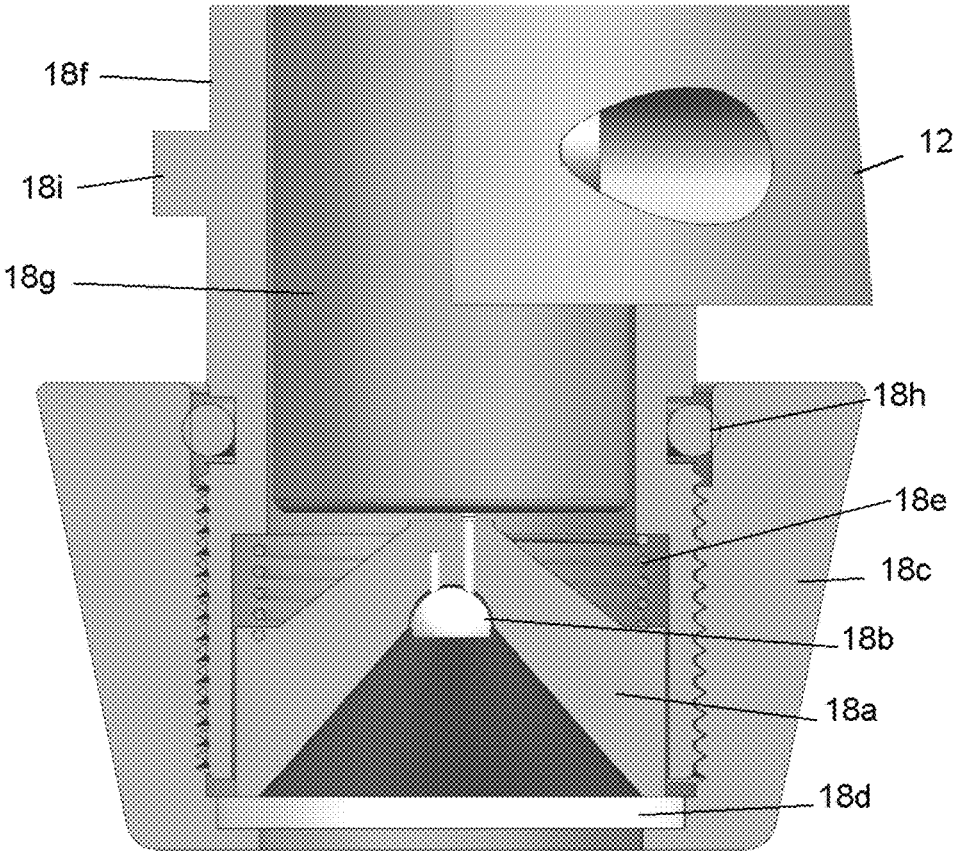
FIG. 7 is an enlarged, partial sectional view of the front end of the flashlight module.

Referring now to FIGS. 5, 6 and 7, the grip 12 may also be equipped with a flashlight module 18 for casting visible or invisible (e.g. IR) light along the grip axis 12*x* and away from the barrel.

To this end, the flashlight module 18 includes a shroud 18*a* with a conical recess that has an LED 18*b* at its internal base. A hard rubber of other material cap 18*c* presses the shroud 18*a* into housing 18*f* and against the bias of spring 18*e* as it is threaded onto threads at the end of housing 18*f*. A transparent lens 18*d* covers the shroud and LED and a rubber O-ring 18*h* engages the inside diameter of cap 18*c* to make the flashlight water tight. One or more batteries 18*g* power the flashlight. Rather than a switch, which may be used in other embodiments of the invention, the illustrated embodiment simply uses the threaded position of cap 18*c* on housing 18*f* to either make contact between one of the electrodes of LED 18*b* and one pole of the battery, or not make such contact. The other electrode of the LED is always electrically connected to the opposite battery pole through the conductive shroud 18*a* and the conductive housing 18*f*, that are both preferably made of metal, e.g. aluminum.

A flange 18*i* on the housing 18*f* sits in a recess in the grip halves to keep the flashlight module fixed in the grip 12.

In further embodiments of the invention the mono-pod 16 and flashlight module 18 may use threaded parts to be more easily interchangeable through the lower end of the grip 12 without having to disconnect the grip halves.

The elastomer or rubber member making up the flexible joint 14 is, for example, polyurethane rubber supplied by Fibro GmbH of Weinsberg, Germany, as a product sold under their registered trademark FIBROFLEX. It is preferably a one-piece solid (i.e. not hollow) member with shore hardness of preferably about 65 to 80 or more preferably 75 to 80 shore.

In a further embodiment of the invention, and as mentioned above, the elastomer flexible joint 14 can be replaced by a strong coil spring covered by a durable fabric sleeve.

Figure 10:
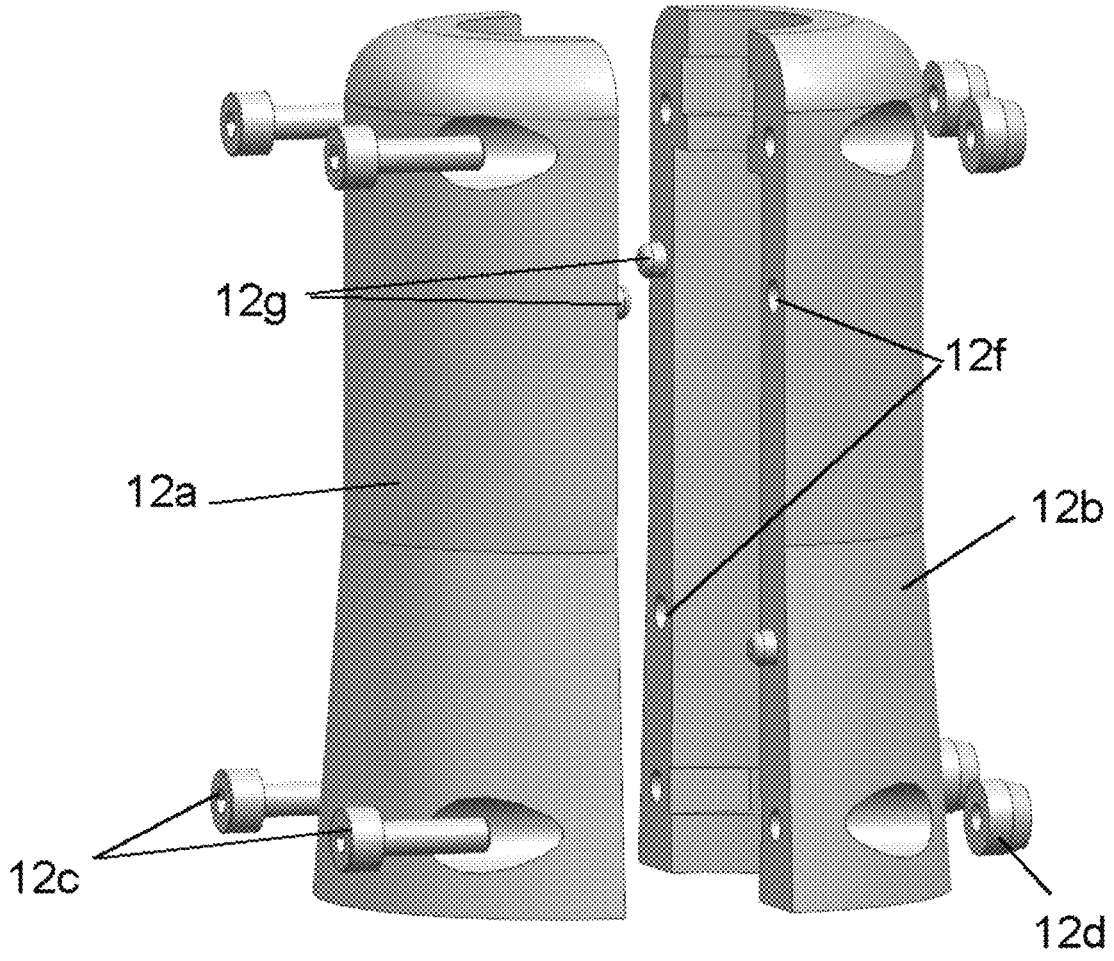
FIG. 10 is an exploded view of another embodiment of the grip.

FIG. 10 illustrates another embodiment of the grip that has handle halves 12*a* and 12*b*, each with two opposed centering pins 12*g* that are engaged in mating centering recesses 12*f* in the facing surfaces of the handle halves, to properly align the halves together as they are secuted together by screws 12*c* and nuts 12*d*.

Figure 11:
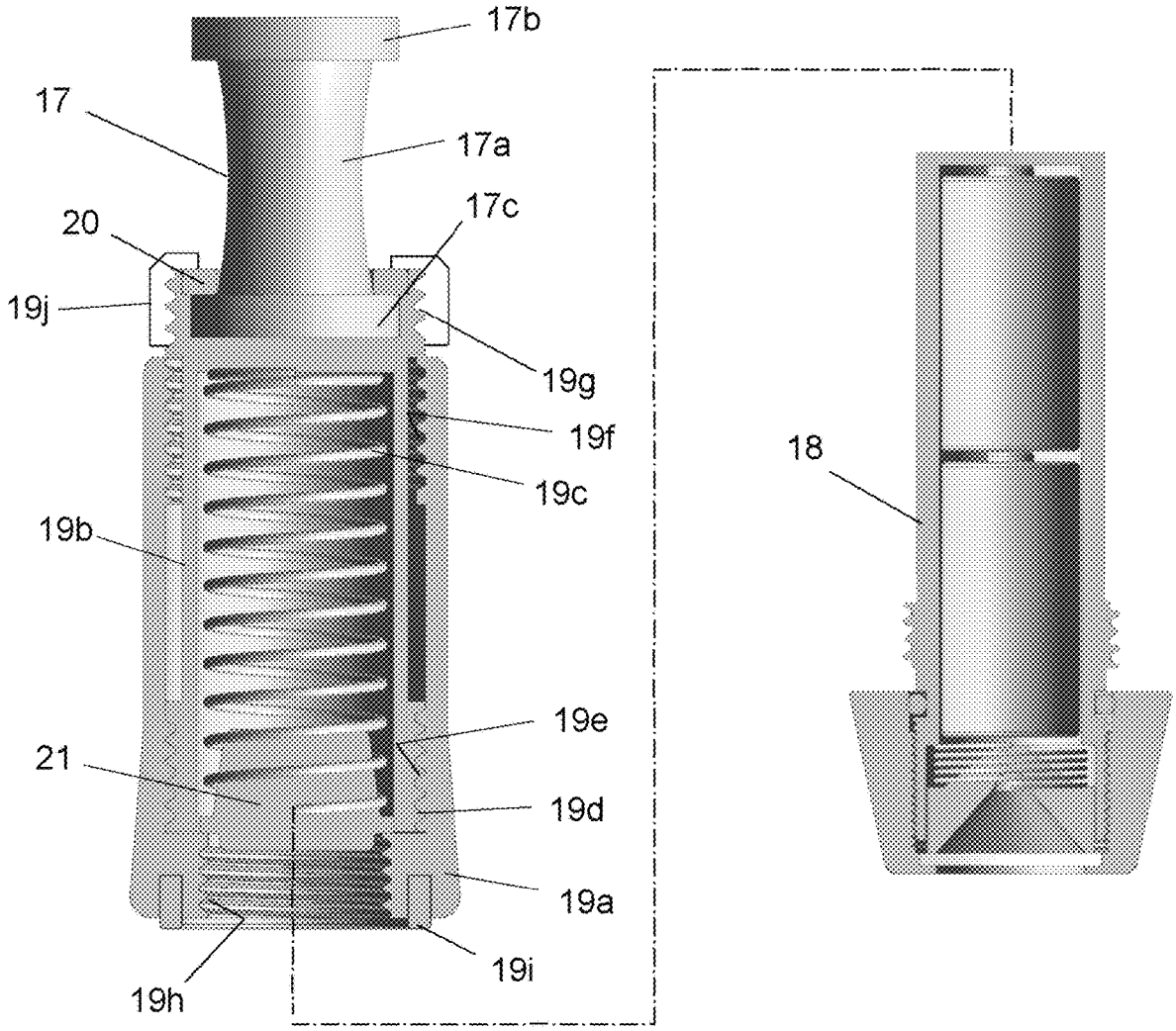
FIG. 11 is a view, partly in section, of a further embodiment of the grip which includes an extended mono-pod feature and can be equipped with a flashlight module.
Figure 12:
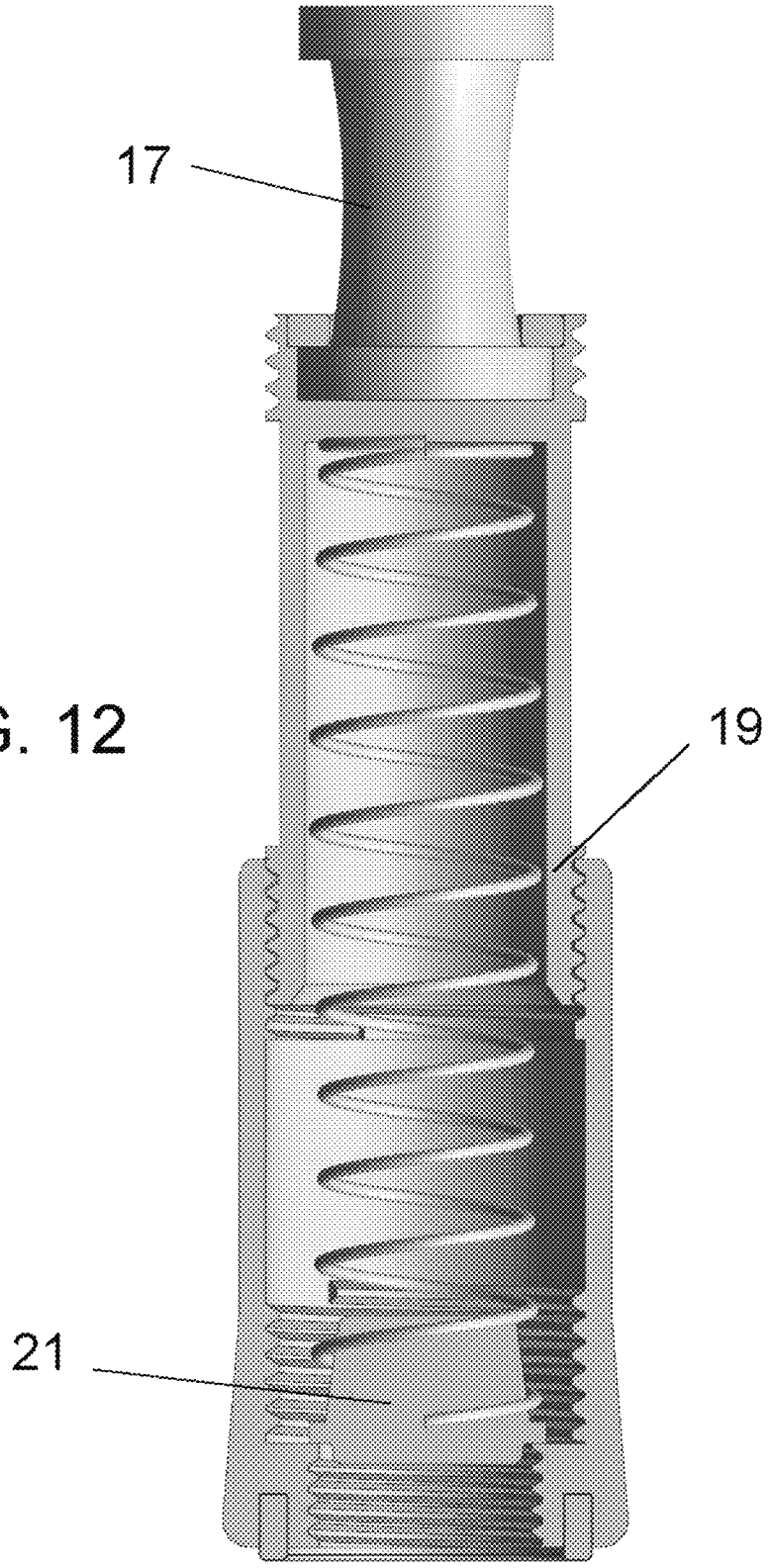
FIG. 12 is a view like FIG. 11 of the grip with the mono-pod retracted.
Figure 13:
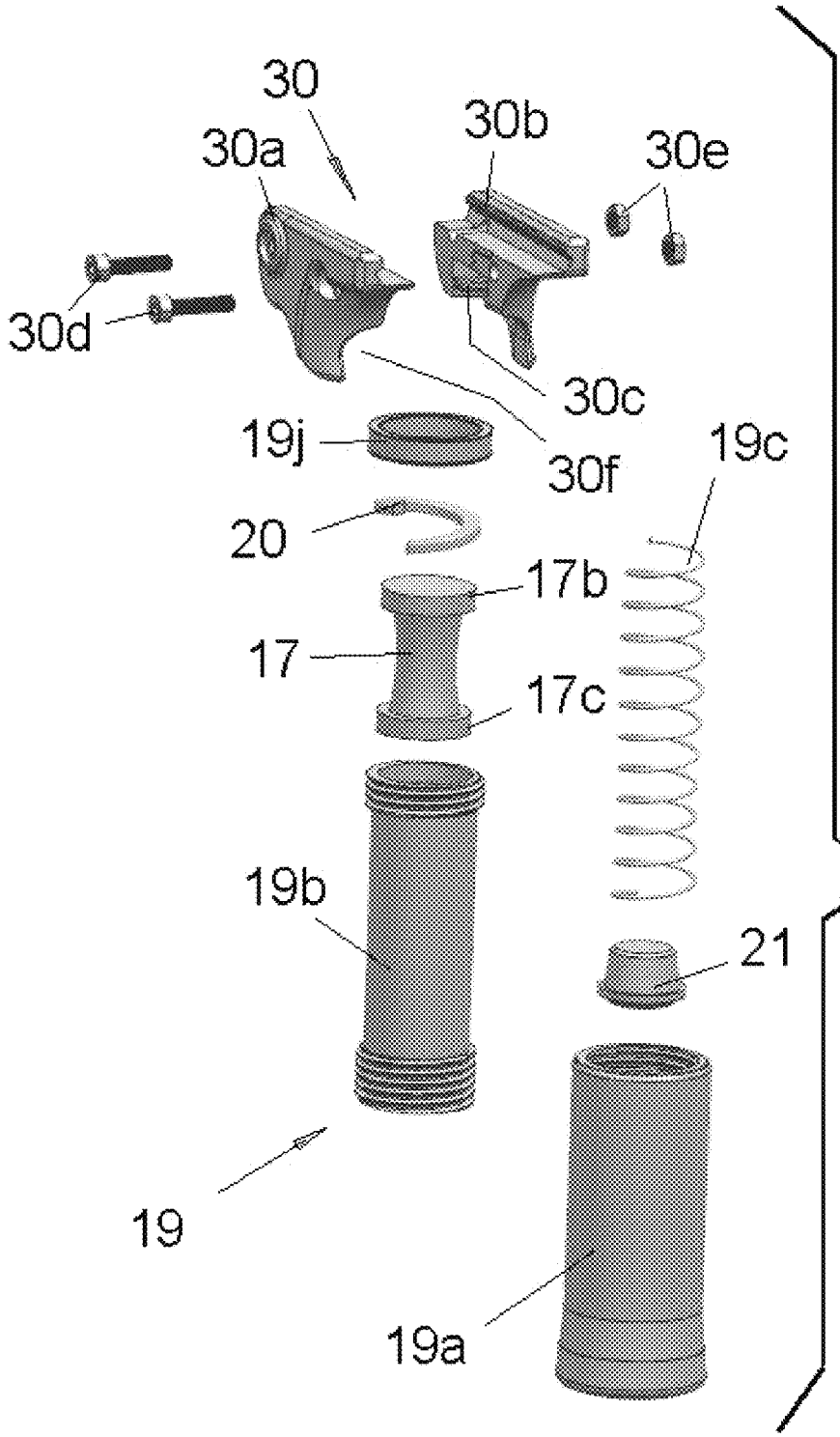
FIG. 13 is an exploded view of the embodiment of FIG. 12 but with a further embodiment of the handguard rail connector.

Referring now to FIGS. 11 to 13, another embodiment of the grip 19 and flexible joint 17 of the grip assembly, are illustrated. The connecters 10 or 11 of the other embodiments can be used with this embodiment of the invention as can the flashlight module of FIG. 6, with slight modifications. In the alterative, the connector 30 of FIG. 13 can be used with the embodiment of FIGS. 11 and 12.

In FIGS. 11 to 13, the flexible joint 17 is a one-piece elongated elastomer member having a central cylindrical portion 17*a* which advantageously has a coke-bottle or reduced diameter central part that smoothly tapers outwardly to larger diameter ends. Each end of the portion 17*a* is integrally connect to upper and lower larger diameter cylindrical portions 17*b* and 17*c*, that are respectively pressure fit into mating recesses in the connector (not shown in FIGS. 11 and 12) and the grip 19. This pressure fit and the high coefficient of friction of the elastomer create the non-rotatable characteristic of the joint, connector and grip, so that no non-round shapes are needed in the large diameter portions 17*b* and 17*c*.

The grip 19 includes an integrated mono-pod as it comprises an outer cylinder 19*a* that can telescope with an inner cylinder 19*b*. A spring 19*c* biases these two cylinders away from each other from the retraced position of FIG. 11 to the extended position of FIG. 12. The retracted position of FIG. 11 is maintained by the threading of lower outer threads 19*d* of the inner cylinder 19*b*, with lower inner threads 19*e* of the outer cylinder 19*a*.

To extend the mon-pod, the user unthreads threads 19*e* from threads 19*d* and allows spring 19*c* to push the outer cylinder 19*a* down and outwardly of the grip combination, toward the position of FIG. 12. The user then threads upper inner threads 19*f* of the outer cylinder 19*a* to the lower threads 19*d* of inner cylinder 19*b* to keep the mon-pod extended.

In either the retracted or extended position, an elastomer plug 21 is biased downwardly against the lower opening in the outer cylinder 19*a*, to keep foreign material out of the grip. This plug 21 can be pushed up into the grip 19 against the bias of spring 19*c*, when a flashlight module 18 is pushed into the volume of inner and outer cylinders 19*a*, 19*b*, and is threaded the inner opening threads 19*h* of the outer cylinder 19*a*. For this purpose, flashlight module 18 has outer threads that thread to lower opening threads 19*h* of the grip outer cylinder 19*a* of grip 19.

Inner and outer grip cylinders 19*b* and 19*a* are make of hard plastic or other durable material. To provide a high-friction, non-slip character to the bottom of the mon-pod/grip 19, a softer, high-friction, e.g. rubber ring 19*i* is captured in an annual slot in the bottom surface of cylinder 19*a* and extended beyond this bottom surface.

To non-rotatably fix the lower flexible joint portion 17*c* to the grip 19, a compressible split washed 20 is pressure fit into an upper annular recess in the upper end of the inner cylinder 19*b* over the portion 17*c* that also sits in this recess. To further secure this connection, a cap 19*j* can be threaded to upper threads 19*f* of cylinder 19*b*, over the split washer 20.

FIG. 13 is useful for understanding the parts that make up the grip and joint of FIGS. 11 and 12. FIG. 13 also illustrated a further embodiment of the connector, namely and connector 30.

Connector 30 in FIG. 13 is preferably made of hard durable material like suitable metal or synthetic polymer and has two halves 30*a* that together form an internal annular recess 30*c* that closely received the upper large diameter portion 17*b* of flexible joint 17. Connector 30 also has a channel 30*a* for engaging the handguard rail and a set screw (not shown) for fixing the connecter to the handguard. The close fit of portion 17*b* in recess 30*c* creates the anti-rotation effect for joint 17 in connector 30. The front lower part of connected 30 is also shaped with a curved finger recess 30*f* for the user's index finger if the user wishes to increase the security of his/her hold on the grip-plus-connector combination. Connector halves 30*a* are fixed together by screws 30*d* and nuts 30*e*.

Figure 15:
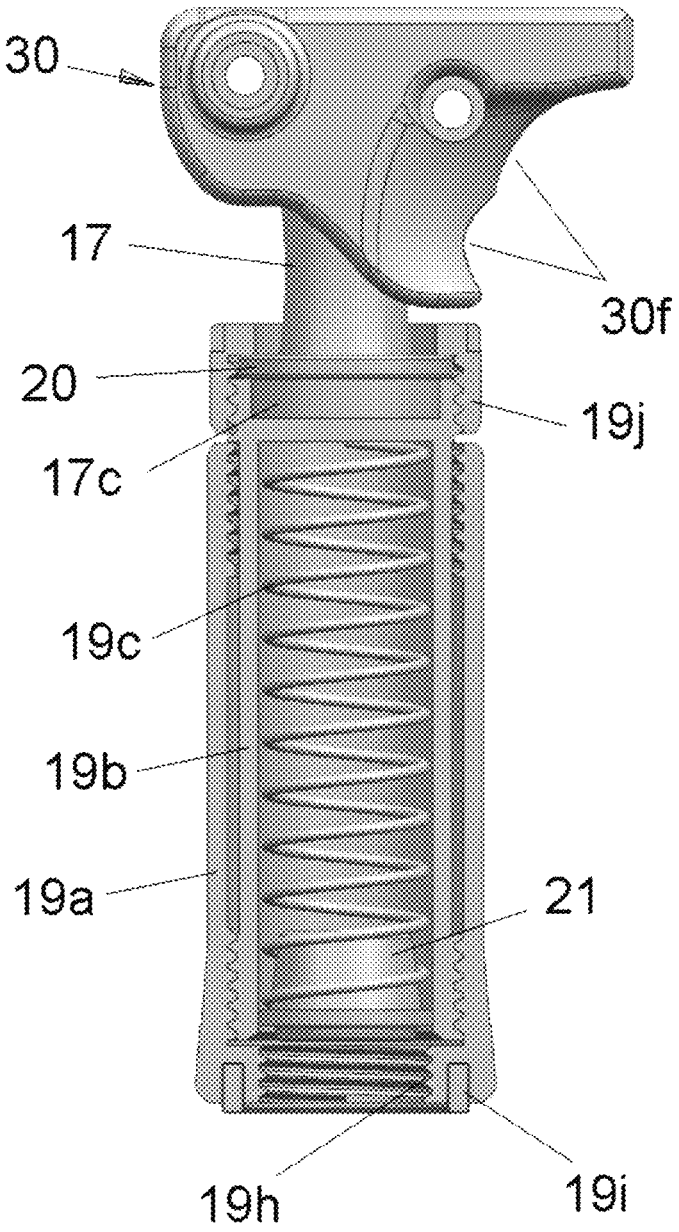
FIG. 15 is a view partly in section of the embodiment if FIG. 13 in an assembled and retraced state for the mono-pod.
Figure 16:
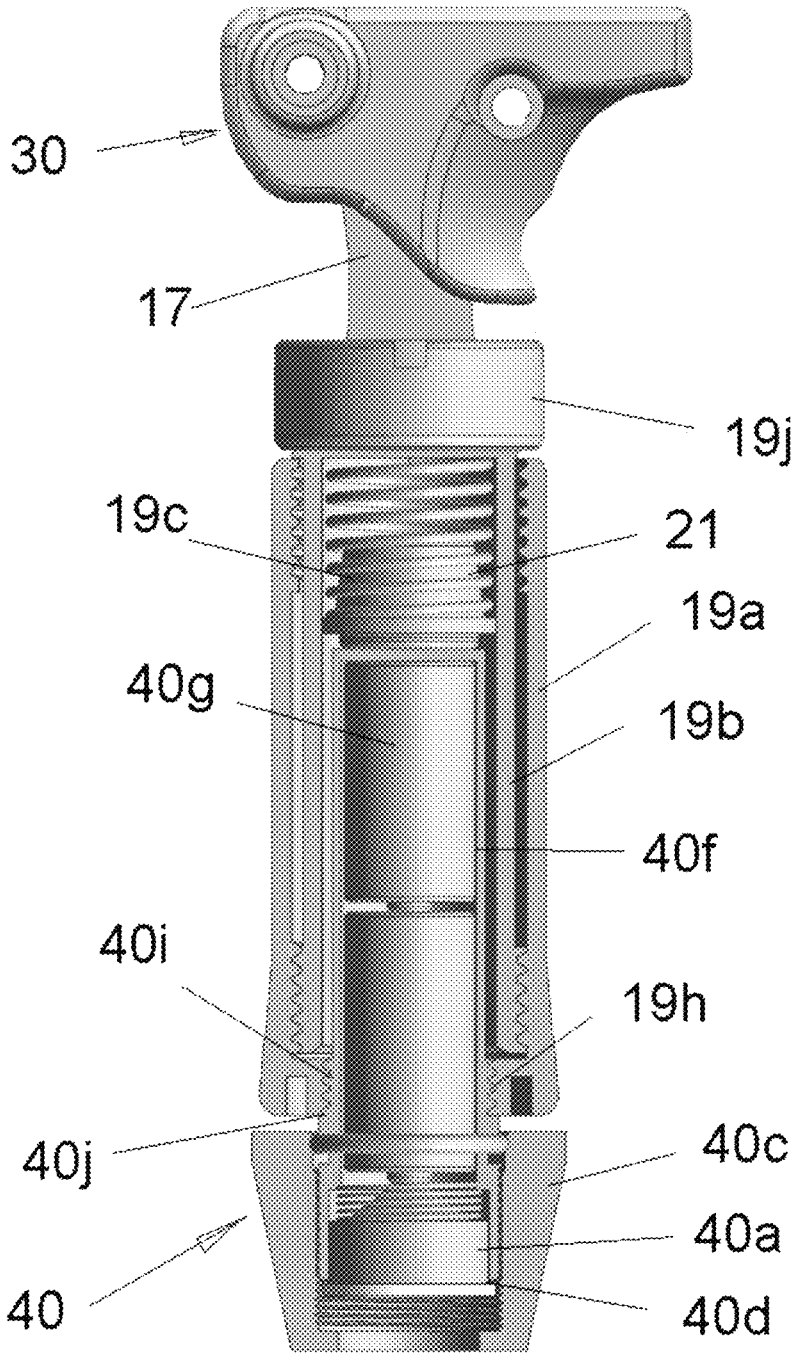
FIG. 16 is a view like FIG. 15 but with a flashlight module of the invention inserted.

As also visible in FIGS. 15 and 16, retaining cap 19*j* presses split washer 20 down on lower flexible joint portion 17*c* and is threaded to upper thread 19*g* of the inner cylinder 19*b* of grip 19 to create an anti-rotation connection between joint 17 and grip 19. The remaining parts of the grip are the same as those shown in FIGS. 11 and 12.

FIG. 16 illustrates a flashlight module 40 of the invention that has similar parts to those of flashlight 18 in FIG. 6 but can be a high or low, visible or invisible LED light source. Flashlight module 40 is installed by being inserted into the open end of grip 19, pushing the elastomer plug 21 up against spring 19*c* in inner cylinder 19*b*.

Flashlight module 40 includes a shroud 40*a* with a conical recess that has an LED at its internal base that can be a one or two watt white LED or other form of LED suited to the purpose of the weapon and mission. A hard rubber of other material cap 40*c* presses the shroud 40*a* into housing 40*f* of the flashlight module, and against the bias of spring 40*e* as it is threaded onto threads at the end of housing 40*f*. A transparent lens 40*d* covers the shroud and LED and a rubber O-ring 40*h* on the flashlight housing engages the inside diameter of cap 40*c* to make the flashlight water tight.

One or more batteries 40*g* power the flashlight. Rather than a switch, which may be used in other embodiments of the invention, the illustrated embodiment simply uses the threaded position of cap 40*c* on housing 40*f* to either make contact between one of the electrodes of LED and one pole of the battery, or not make such contact. The other electrode of the LED is always electrically connected to the opposite battery pole through the conductive shroud 40*a* and the conductive housing 40*f*, that are both preferably made of metal, e.g. aluminum.

An outside thread 40*i* on the housing 40*f* is threaded to inside thread 19*h* of outer cylinder 19*a* of grip 19 to fix flashlight module 40 to the grip 19. Threads 40*i* and 19*h* are tightened so that a step 40*j* of the flashlight housing firmly engages the lower opening edge of grip cylinder 19*a* so that the cap 40*c* can be threaded in either direction to activate and deactivate the flashlight without unscrewing the flashlight module from the grip.

Figure 14:
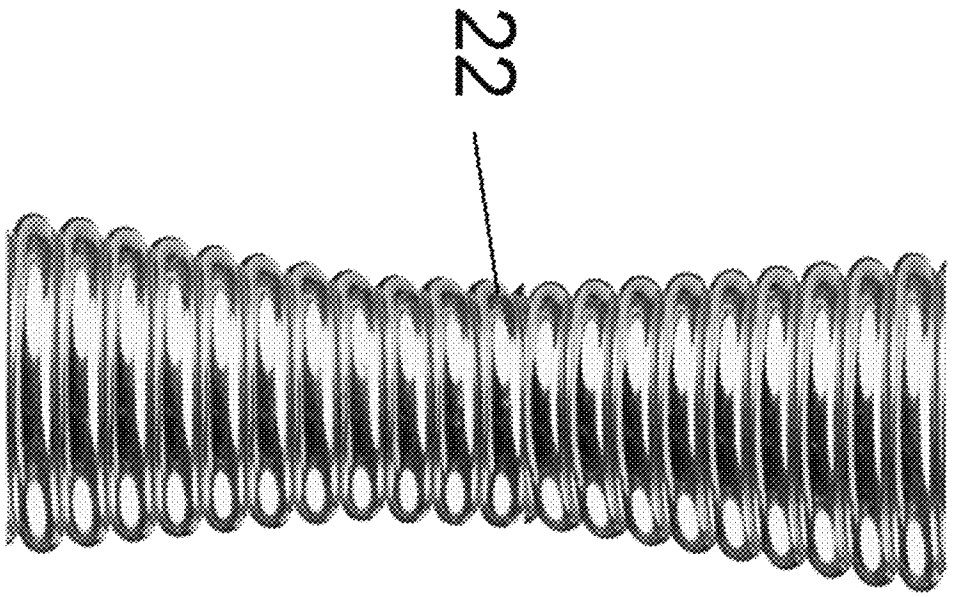
FIG. 14 is a view of an alternate embodiment of the flexible joint of the invention.

FIG. 14 illustrates an alternate embodiment for the flexible joint 22 in the from of a tightly coiled coil spring with enlarged upper and lower ends for being secured to a connector and a grip of the present invention. Such a flexible joint is covered by a durable fabric like nylon or is left uncovered.

Figure 17:
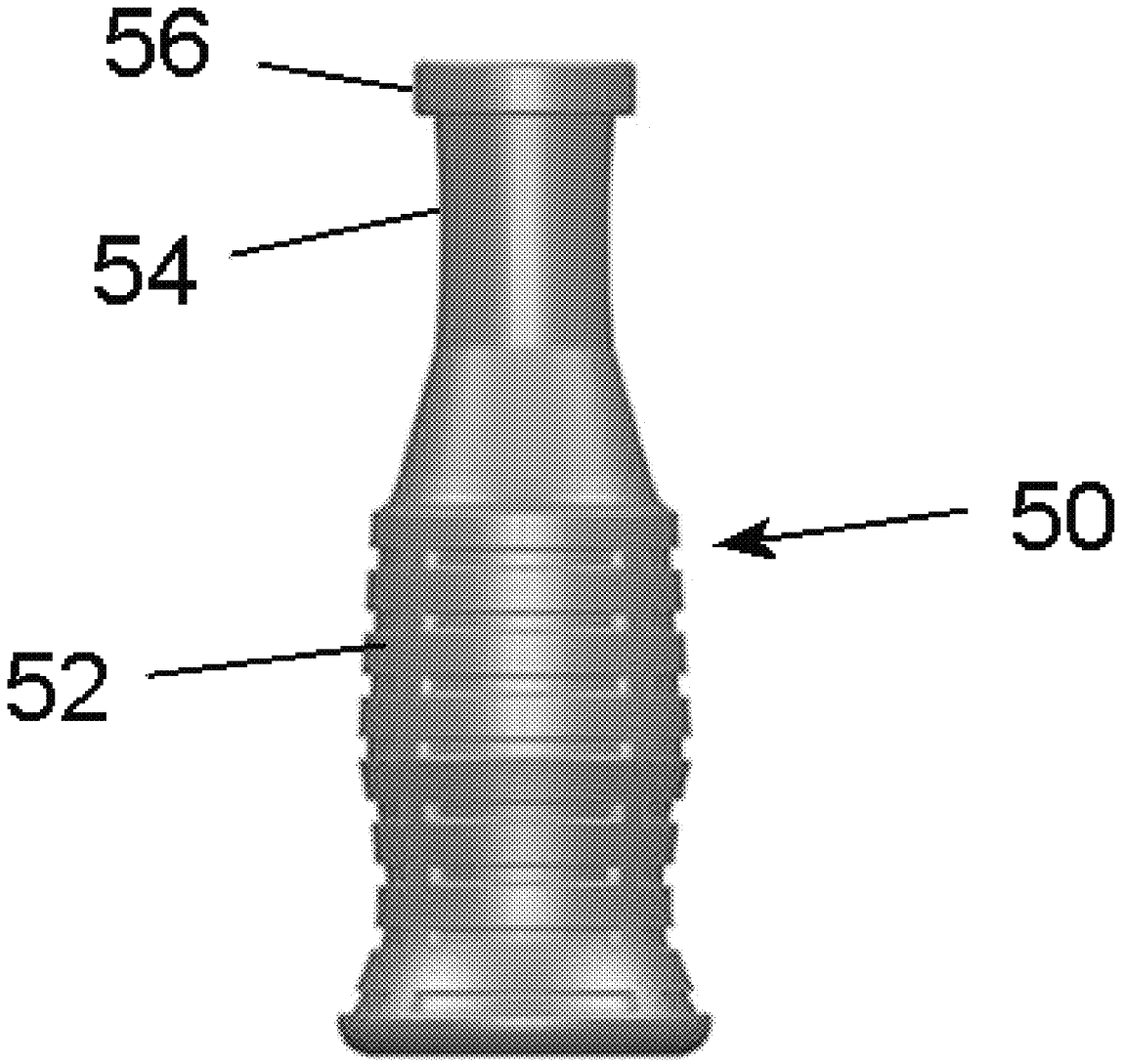
FIG. 17 is a side view or another embodiment of the invention using a one piece combination grip-plus-flexible joint combination.

With reference to FIG. 17, a one-piece grip sub-assembly 50 made of durable elastic material such as the FIBROFLEX brand polyurethane rubber mentioned above, or other suitable material, comprises a grip 52 as well and the flexible joint 54 of the grip sub-assembly. A larger diameter cylindrical or other larger dimensions portion 56 at the top of the subassembly is connected to a connector such as the connector 10 of FIG. 3 or the connector 30 of FIG. 13 to secure the subassembly to the weapon handguard. No core is needed in grip subassembly and the smaller diameter of the flexible joint 54 is all that is needed to allow flexing of the joint with providing sufficient structural integrity for the larger diameter and shaped contour of the grip 52. As illustrated in FIG. 17, a ringed or other pattern of any suitable kind can be formed in the outer surface of the grip 52 to enhance a user's hold on the grip. As with the other embodiments of the invention, the embodiment of FIG. 17 has the advantages of immediate repositioning of the grip axis with no extra movements required of the user that may through off correct aim and firing of the weapon, while at the same time have the advantage of flexibly moving out of the way when sticking an obstacle.

While specific embodiments of the invention have been shown and described in detail to illustrate the application of the principles of the invention, it will be understood that the invention may be embodied otherwise without departing from such principles.

What is claimed is:

1. A handguard grip assembly for a rifle (100) having a barrel (114) with a barrel axis (114*a*), and a handguard (110) extending at least partly around the barrel, the assembly comprising:

a connector adapted to be fixed to the rifle handguard;

a grip having a grip axis and being adapted to be held by a user of the rifle, wherein the grip is a one-piece, coreless elastomer grip, comprising an integral connecting portion (56) at a first end thereof, the integral connecting portion received in the connector; an integral, flexible joint portion (54) below the integral connected portion and adapted to allow flexibly repositioning the grip axis; and a tapered portion connecting the joint portion (54) to a lower grip portion (52), the lower grip portion having a larger diameter than the connecting portion, and the connecting portion having a larger diameter than the joint portion; and wherein the flexible joint portion allows the grip to pivot as long as the grip is being held, so that the grip axis is at any selected angle to the barrel axis.

2. The grip assembly according to claim 1, wherein the handguard includes a mounting rail, the connector having a channel for engaging the rail.

3. A handguard grip assembly comprising:

a connector adapted to be fixed to a barrel of a rifle, the barrel having a barrel axis;

a grip having a grip axis and being adapted to be held by a user of the rifle, wherein the grip is a one-piece, coreless elastomer grip, comprising an integral connecting portion (56) at a first end thereof, the integral connecting portion received in the connector; an integral, flexible joint portion (54) below the integral connected portion and adapted to allow flexibly repositioning the grip axis; and a tapered portion connecting the joint portion (54) to a lower grip portion (52), the lower grip portion having a larger diameter than the connecting portion, and the connecting portion having a larger diameter than the joint portion; and wherein the flexible joint portion allows the grip and grip axis to pivot to any angle with respect to the barrel axis.

4. The grip assembly according to claim 3, including a handguard over the barrel and a mounting rail on the handguard, the connector having a channel for engaging the rail.

5. The grip assembly according to claim 3, wherein the flexible joint portion is an elongated elastomer member.

6. The grip assembly according to claim 3, wherein the flexible joint portion is an elongated elastomer member having an upper end non-rotatably fixed to the connector and a lower end non-rotatably fixed to the lower grip portion.

* * * * *